US006183294B1

(12) United States Patent
Fan et al.

(10) Patent No.: US 6,183,294 B1
(45) Date of Patent: Feb. 6, 2001

(54) ELECTRICAL CONNECTOR

(75) Inventors: Chia Hao Fan, Su-Lin; Yao-Hao Chang, Tu-Chen, both of (TW)

(73) Assignee: Hon Hai Precision Ind. Co., Ltd., Taipei Hsein (TW)

( * ) Notice: Under 35 U.S.C. 154(b), the term of this patent shall be extended for 0 days.

(21) Appl. No.: 09/427,381

(22) Filed: Oct. 25, 1999

(30) Foreign Application Priority Data

Feb. 2, 1999 (TW) ..... 88201716

(51) Int. Cl.[7] ..... H01R 13/73
(52) U.S. Cl. ..... 439/567; 439/607
(58) Field of Search ..... 439/567, 571, 439/572, 607

(56) References Cited

U.S. PATENT DOCUMENTS 5,630,730 * 5/1997 Wang et al. ..... 439/567
5,709,556 * 1/1998 Tan et al. ..... 439/567
5,733,142 * 3/1998 Clark ..... 439/567
5,807,135 * 9/1998 Clark ..... 439/567
6,012,954 * 1/2000 Wu ..... 439/567

* cited by examiner

*Primary Examiner*—Gary F. Paumen
(74) *Attorney, Agent, or Firm*—Wei Te Chung

(57) ABSTRACT

An electrical connector for being securely mounted to a printed circuit board and providing more than one grounding path comprises a dielectric housing with a pair of fitting portions formed on a rear face thereof, a contact module and a spacer attached between the fitting portions, a conductive shell attached to a front face of the housing, a pair of boardlocks and a pair of fixing pieces. Each boardlock comprises a main body, a first extending portion, a second extending portion, and a pair of spaced legs downwardly extending therefrom for firmly connecting to the printed circuit board and providing a grounding path. A conductive protrusion formed on each fixing piece electrically and mechanically connects to the front shell via an aperture in the first extending portion of the boardlock and a receiving cavity of the dielectric housing. A guiding post on each fixing piece completes a second grounding path.

1 Claim, 3 Drawing Sheets

ELECTRICAL CONNECTOR

BACKGROUND OF THE INVENTION

1. Field of the Invention

The present invention relates to an electrical connector, and particularly to an electrical connector for being securely mounted to a printed circuit board and providing more than one grounding path between the electrical connector and the printed circuit board for eliminating noise interference.

2. Prior Art

With the development of computer technology, more and more electrical connectors mounted to a printed circuit board must provide high frequency transmission to achieve better computer performance. Thus electromagnetic or radio frequency interference becomes an important issue for the electrical connector to overcome.

A method for providing a grounding path for discharging residual static electricity from an electrical connector and decreasing interference during data transmission is exemplified by FIG. 3. An electrical connector 7 comprises a dielectric housing 71, a pair of boardlocks 72 and a pair of connecting inserts 73 (only one shown). Each boardlock 72 comprises a substantially square plate 721 and a pair of spaced locking legs 722. An aperture 723 is defined through the square plate 721. Each connecting insert 73 has a barrel 731 extending therefrom with an opening 732 defined therethrough. A recess 711 and a receiving hole 712 are formed in opposite ends of the dielectric housing 71. Each boardlock 72 is securing to the housing 71 by inserting the square plate 721 in the recess 711 and extending the barrel 731 of the connecting insert 73 through the aperture 723 and the receiving hole 712. Thus, the connecting insert 73 secures the boardlock 72 to the housing 71. While transmitting data via an electrical connector, noise interference is commonly absorbed by a shielding shell and discharged to a printed circuit board via a grounding path. The grounding path of the connector 7 is provided by a shielding shell (not labeled), the barrel 731 and the boardlock 72 and directed to the printed circuit board. However, not only is the grounding path too long but it also has a large contact resistance since the grounding path is formed by many elements. If the grounding path is interrupted for some reason, such as by incorrect assembly, the anti-interference function will fail due to the provision of only one grounding path.

Furthermore, in order to achieve the goal of convenient and fast assembly as well as to properly position the connector on the printed circuit board, a guiding apparatus should be provided. With the development of manufacturing automation, most electrical connectors are mounted to a printed circuit board via surface mounting procedures, such as wave soldering or reflowing, whereby the electrical connector of FIG. 3 may not be properly attached to the printed circuit board. Furthermore, manufacturing costs of the connector of FIG. 3 will be increased. The copending application Ser. No. 09/053,417 filed April 1998 and having the same assignee with the invention, also discloses another type prior art connector having retention devices thereof.

An object of this invention is to provide an electrical connector which can overcome the aforementioned drawbacks and disadvantages of the conventional invention.

SUMMARY OF THE INVENTION

An object, therefore, of the invention is to provide an electrical connector which can be securely mounted to a printed circuit board and provide more than one grounding path.

Accordingly, an electrical connector in accordance with present invention comprises a dielectric housing, a conductive shell, a pair of boardlocks and a pair of fixing pieces. Each boardlock comprises a main body, a pair of spaced legs downwardly extending therefrom for firmly connecting to the printed circuit board, a first extending portion and a second extending portion. The extending portions are parallel to each other and extend from the main body. The first extending portion fits in a corresponding recess formed in a rear face of the dielectric housing and defines an aperture therein. The second extending portion integrally forms a solder arm parallel to the printed circuit board for facilitating surface mounting of the electrical connector. The solder arm is perpendicular to the first extending portion and the main body. Each fixing piece forms a downwardly extending guiding post perpendicular to the printed circuit board for providing positioning capability, a conductive protrusion, and a joint part formed therebetween. The conductive protrusion of each fixing piece mechanically and electrically connects to the conductive shell via the aperture of the first extending portion of the boardlock and a receiving cavity of the dielectric housing.

The present invention, therefore, provides two grounding paths, one through the boardlock and the other through the fixing piece. The solderability of the electrical connector is also improved.

DETAILED DESCRIPTION OF THE INVENTION

Figure 1:
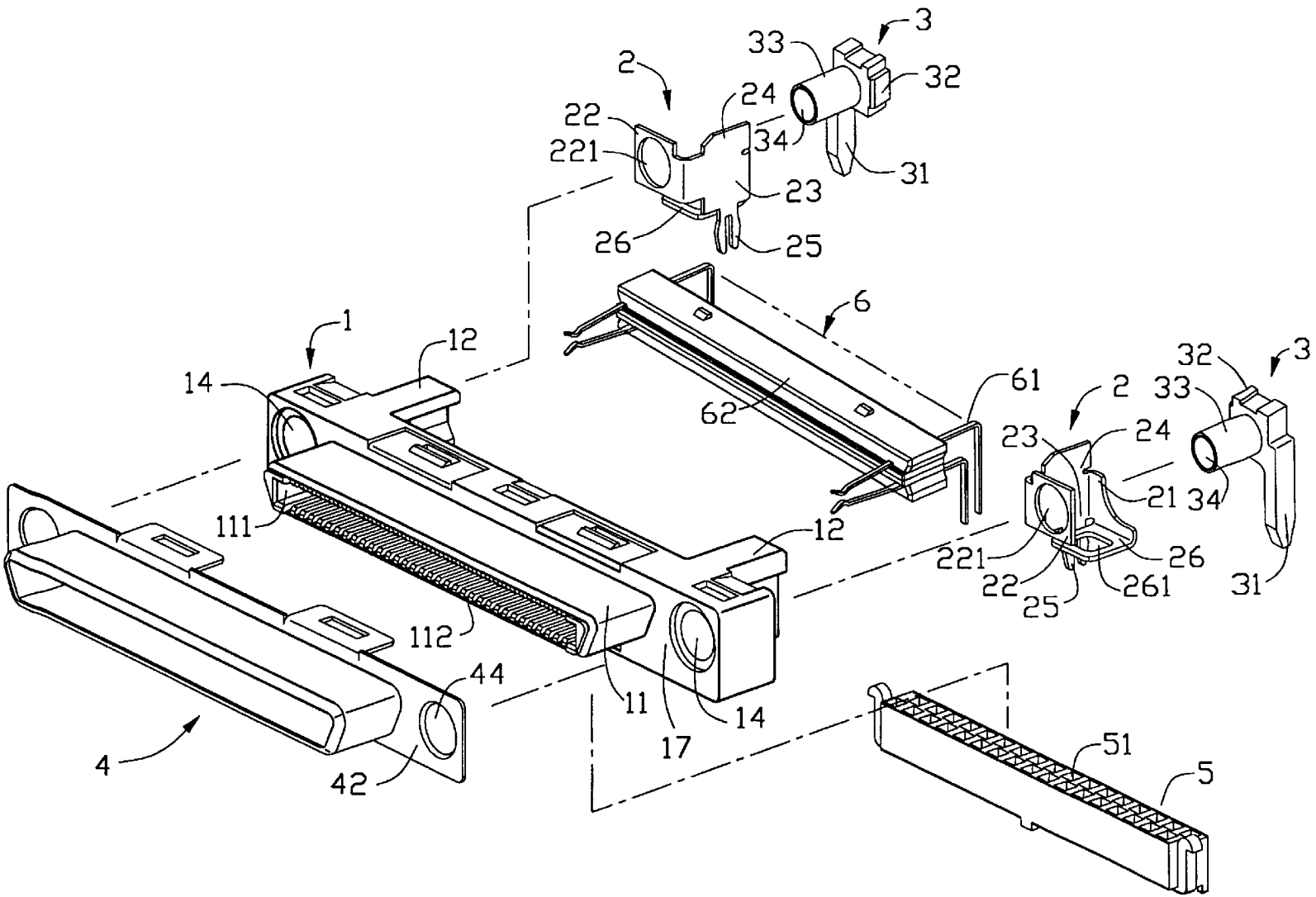
FIG. 1 is an exploded view of an electrical connector in accordance with present invention.

With reference to FIG. 1, an electrical connector in accordance with a preferred embodiment of the present invention comprises a dielectric housing 1, a pair of boardlocks 2, a pair of fixing pieces 3, a conductive shell 4, a spacer 5, and a contact module 6. The conductive shell 4 has a mating face 42 with a pair of fixing holes 44 formed in opposite ends thereof.

Figure 2:
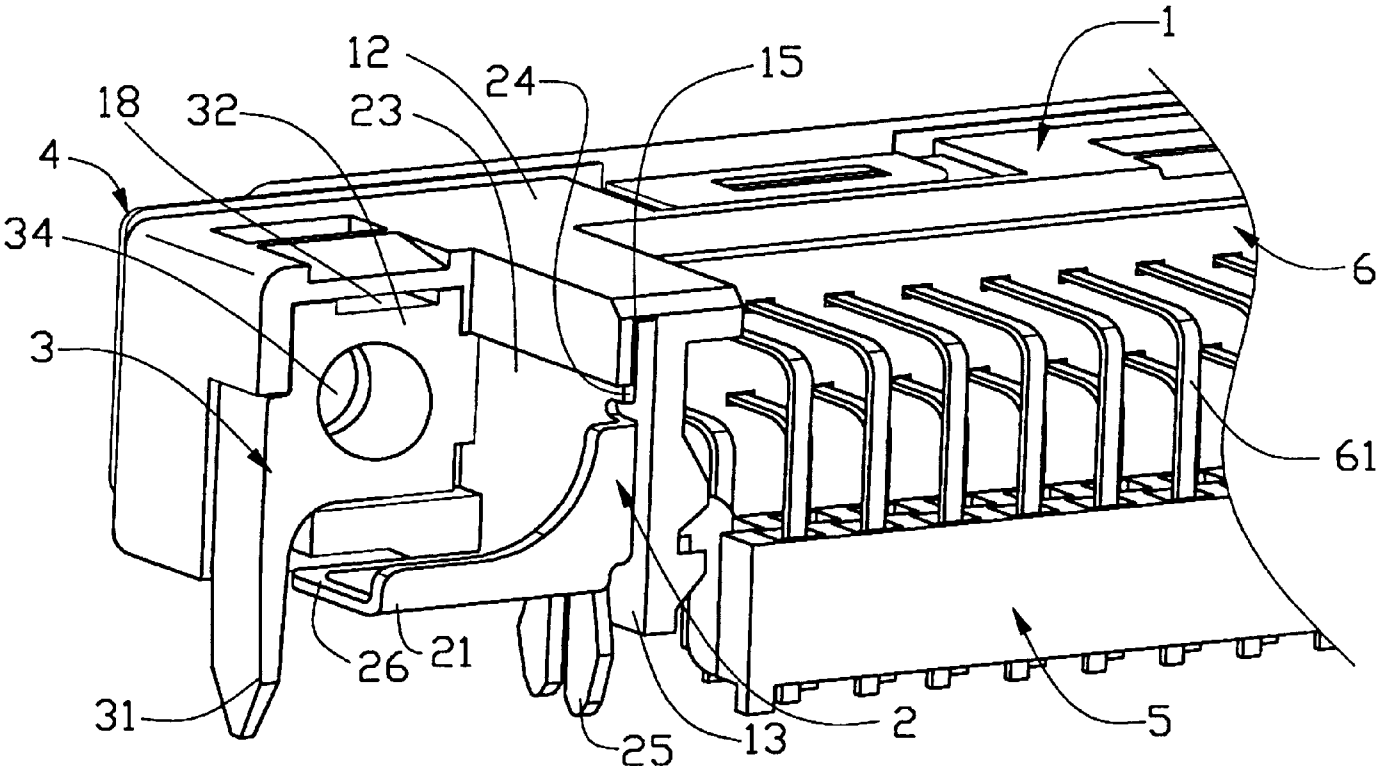
FIG. 2 is a rear, partial perspective view of the assembled electrical connector.
Figure 3:
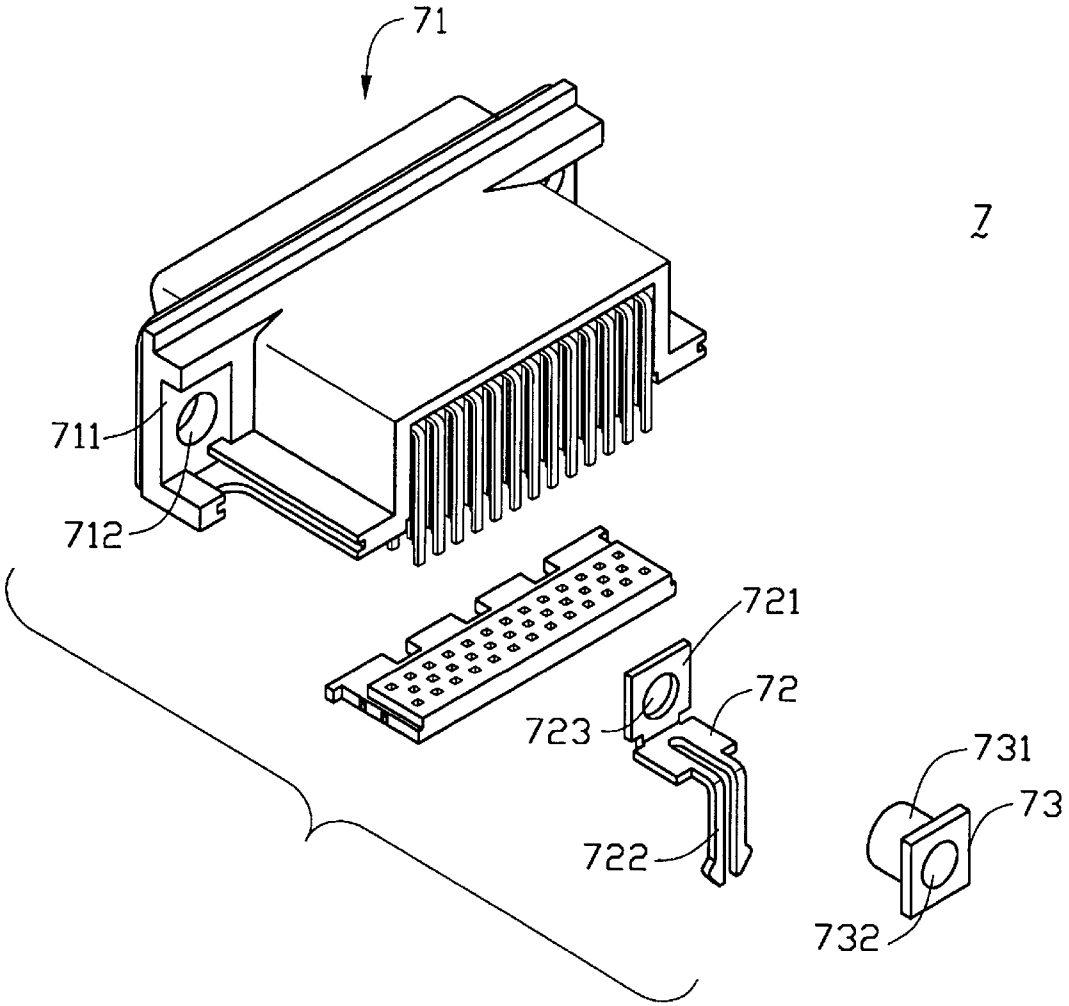
FIG. 3 (PRIOR ART)
FIG. 3 is an exploded view of a conventional electrical connector.

The dielectric housing 1 forms a joint face 17 and a pair of receiving cavities 14 through opposite ends thereof. A convex extension 11 with a longitudinal mating opening 111 formed therein is formed on the joint face 17. The mating opening 111 is formed with a plurality of receiving slots 112 configured therein. A pair of fitting portions 12 rearwardly extend from the housing 1 opposite the joint face 17. Also referring to FIG. 2, each fitting portion 12 forms a baffle 13, and defines a slot 15 adjacent the baffle. A recess 18 is defined at each end of a rear face (not labeled) opposite the joint face 17 of the housing 1 and in connection with a corresponding receiving cavity 14.

The boardlock 2, made of conductive material, comprises a main body 23 and a sidewall 24 extending therefrom, a first extending portion 22, a second extending portion 21 and a pair of spaced legs 25 downwardly extending from the main body 23 for firmly connecting with a printed circuit board. The extending portions 21,22 perpendicularly extend from the main body 23. The first extending portion 22 defines an aperture 221 therein, and the second extending portion 21 has a solder arm 26 perpendicularly extending therefrom.

The solder arm 26 is parallel to the printed circuit board and forms a soldering hole 261 therein for facilitating surface mounting of the electrical connector to the printed circuit board.

Each fixing piece 3 comprises a conductive protrusion 33, a guiding post 31 and a joint part 32 formed therebetween. The conductive protrusion 33 has a bore 34 defined therethrough and, in assembly, extends through the fixing hole 44 of the conductive shell 4 for forming mechanical and electrical contact with the shell 4 by projecting through the aperture 221 of the corresponding boardlock 2 and the receiving cavity 14 of the dielectric housing 1. The guiding post 31 downwardly extends from the joint part 32 perpendicularly from the conductive protrusion 33 to form an L-shaped connector.

The spacer 5 is an elongate structure forming a plurality of positioning holes 51. The contact module 6 comprises a dielectric block 62 with a plurality of contacts 61 arranged therein. The contact module 6 is inserted between the baffles 13 of the dielectric housing 1. One end of each contact 61 projects toward the receiving slots 112 of the mating opening 111, and the other end extends toward the printed circuit board via the positioning holes 51 of spacer 5.

During assembly, the contact module 6 is received in the housing 1 and the spacer 5 is secured between the baffles 13 of the housing 1 allowing the contacts 61 to be electrically connected with the printed circuit board. The boardlocks 2 and the fixing pieces 3 are assembled to the housing 1. The first extending portion 22 of each boardlock 2 is inserted into the corresponding receiving hole 18, wherein the sidewall 24 is secured in the slot 15 of the fitting portion 12 and the spaced legs 25 are mounted to the printed circuit board. The conductive protrusion 33 of each of the fixing pieces 3 projects into the corresponding fixing hole 44 of the conductive shell 4 via the aperture 221 of the boardlock 2 and the receiving cavity 14 of the dielectric housing 1.

Thus, the connector of the present invention provides two grounding paths, one through the boardlock 2 and the other by way of the fixing piece 3 connecting with a grounding trace on the printed circuit board. In addition, the present invention provides an electrical connector with better solderability and a retaining apparatus for being firmly mounted to a printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted to a printed circuit board, comprising:

a dielectric housing forming a pair of fitting portions on a rear face thereof and a pair of receiving cavities at opposite ends thereof;

a conductive shell mounted on a front face of the housing;

a pair of boardlocks each secured to a corresponding fitting portion and comprising a main body, perpendicular to the printed circuit board two extending portions substantially perpendicular to said main body, a solder arm integral with one of the two extending portions, and a pair of spaced legs extending from said main body for insertion into the printed circuit board; and a pair of fixing pieces each connected to a corresponding boardlock and each forming a guiding post extending perpendicular to a printed circuit board, said fixing piece being secured to said conductive shell for providing a grounding path toward a printed circuit board;

wherein the rear face of said housing defines a recess at either end thereof and in communication with the corresponding receiving cavities for receiving each said boardlock and each said fixing piece;

wherein said solder arm extending from said one extending portion is parallel to the printed circuit board;

wherein each said main body further comprises a sidewall integrally extending therefrom for being embedded in a slot configured in said fitting portion;

wherein the fixing piece comprises a protrusion integrally and perpendicularly connected with said guiding post;

wherein one of said extending portions has an aperture corresponding to the protrusion of said fixing piece and said conductive shell defines a pair of fixing holes at opposite ends of said shell, and whereby respective said apertures and fixing holes are coaxial with respective said receiving cavities of the housing;

wherein each said protrusion projects through a respective one of said apertures of said extending portions and said receiving cavities of said housing, and said fixing holes of said shield.

* * * * *